United States Patent [19]

Phillips

[11] 4,210,784

[45] * Jul. 1, 1980

[54] SPEAKER SYSTEM

[75] Inventor: William W. Phillips, Rancho Palos Verdes, Calif.

[73] Assignee: Shaymar, Inc., Beverly Hills, Calif.

[ * ] Notice: The portion of the term of this patent subsequent to Apr. 26, 1994, has been disclaimed.

[21] Appl. No.: 789,457

[22] Filed: Apr. 21, 1977

Related U.S. Application Data

[63] Continuation-in-part of Ser. No. 728,933, Oct. 4, 1976, Pat. No. 4,061,877.

[51] Int. Cl.[2] ..... H04R 1/32

[52] U.S. Cl. ..... 179/146 H; 179/148 R

[58] Field of Search ..... 179/146 H, 148

[56] References Cited

U.S. PATENT DOCUMENTS

| | | | |
|---|---|---|---|
| 2,541,980 | 2/1951 | Antone | 179/1 E |
| 3,976,162 | 4/1976 | Cummings | 179/146 H X |
| 4,061,877 | 12/1977 | Phillips | 179/146 H X |

*Primary Examiner*—James W. Moffitt

[57] ABSTRACT

A stereo speaker system usable with a conventional stereo system to provide marked stereo separation enhancement and clarity enhancement. The stereo speaker system is mountable at the back of a seat and includes two speaker assembly enclosures mounted on a spacer bar on a stand or captured between the seat back and a room wall to maintain the two speakers at a desired separation and orientation behind the head of the seat occupant. Each enclosure includes a chamber substantially occupied by a speaker assembly and a duct portion for directing the sound toward the ears of the listener who is occupying the seat.

8 Claims, 16 Drawing Figures

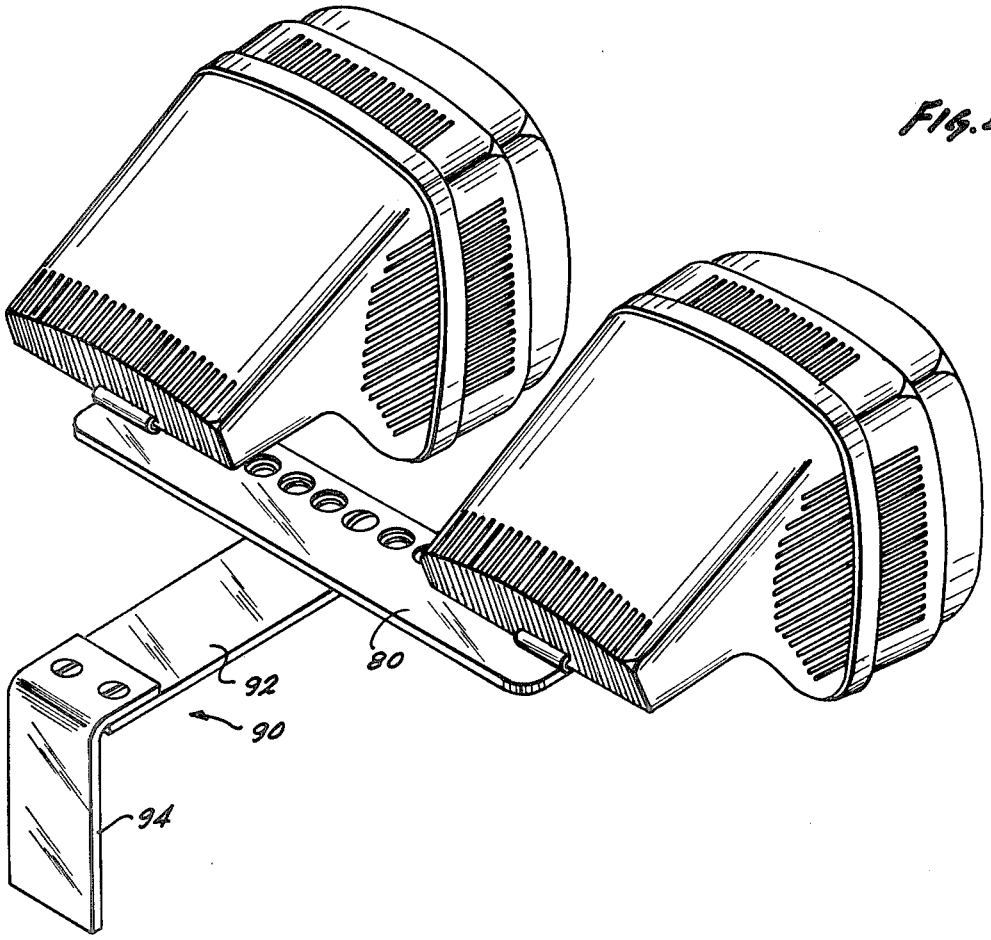
Fig. 11
Fig. 12
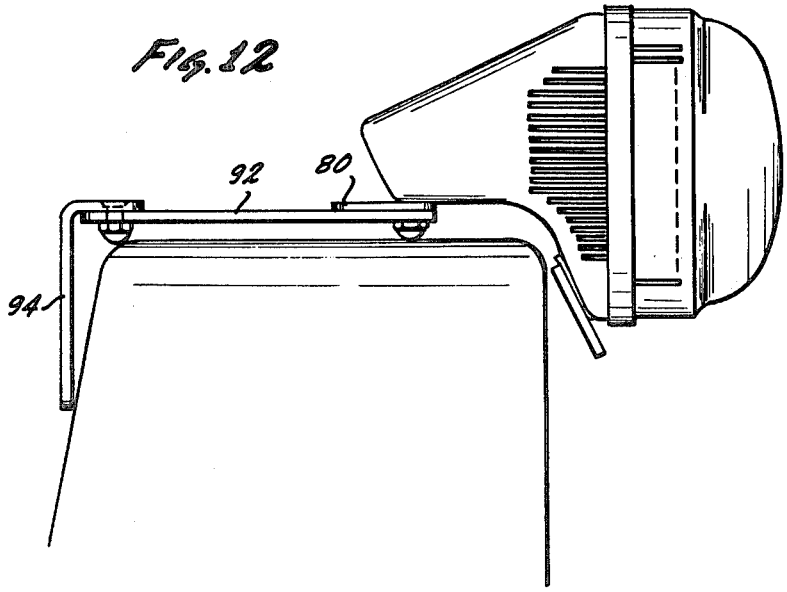

132b
130
132a
132
126
100
140
12b
160
22
110
120a
10
122
124
120
150

12b 161
124
122

SPEAKER SYSTEM

RELATED APPLICATION

This application is related to copending application Ser. No. 624,607, filed Oct. 22, 1975 now U.S. Pat. No. 4,020,284, and is a continuation-in-part of copending application Ser. No. 728,933, filed Oct. 4, 1976 now U.S. Pat. No. 4,061,877.

BACKGROUND OF THE INVENTION

1. Field of the Invention

The present invention is in the field of loud speaker systems and particularly relates to a stereo speaker system which is especially well adapted for mounting at the back of a seat to enhance clarity and stereo separation of a conventional stereophonic or quadraphonic system.

2. The Prior Art

It has long been known in the art that a unique synergistic effect results when two loud speakers are used to reproduce the sounds picked up respectively by two separated microphones. The listener is subjected to the illusion that the reproduced sound is originating at various points around him. Recently it has become known that this effect can be enhanced by the use of four rather than two sound channels to produce a so-called quadraphonic sound.

It is well known that loud speakers can be mounted in a wide variety of locations. U.S. Pat. No. 3,230,320 to Kerr shows a speaker mounted on each side of the head rest of a dental chair. U.S. Pat. No. 3,237,713 to Leslie shows two speakers mounted on opposite sides within a helmet-like acoustical chamber for providing individualized instructions to a student in a classroom. In U.S. Pat. No. 2,541,980, Antone shows a single loud speaker mounted to a hair dryer. All three of these inventions tend to limit the sideward vision of the listener and to limit his ability to move about.

A number of inventions have placed speakers in vehicles for various purposes. U.S. Pat. No. 1,997,408 to Holmes shows a single speaker attachable to the back of a seat on its front surface at one side and positionable vertically relative to the listener's ear. U.S. Pat. No. 3,158,835 shows speakers mounted on the inside of a car closest to the operator's left ear and on the interior top of the car an equal distance from the operator's right ear for use in a safety device to permit the driver to sense the sounds outside the automobile. U.S. Pat. No. 2,908,766 to Taylor shows a pair of speakers mounted on the front side of a seat back on the left and right sides of a passenger's head. These three inventions all have in common the disadvantage that the passenger's sideward vision is obscured by the speakers, and in the event the vehicle lurches sidewardly, the passenger's head will be thrown against the speakers.

An alternative to speakers is the use of head phones. Unfortunately, head phones are not comfortable to wear for long periods of time, and they restrict the ability of the listener to move about freely. Certain types of head phones interfere with the listener's coiffure. When used in a vehicle, head phones are definitely a hazard because they shut out all outside sounds, whether or not the head phones are in operation.

Thus the need can be seen for a stereo speaker system which does not obscure the listener's vision, which does not restrain his freedom of movement, and which, when mounted in a vehicle, will not shut out all outside sounds and which will not present a safety hazard to the listener in the event of a crash.

Commercially, it is highly desirable that the stereo speaker system include means for mounting it to a portion of the vehicle in which it is to be used. Because of the great variety of vehicle shapes and styles, the mounting means must be extremely versatile and must be capable of securing the speaker system to the chosen portion of the vehicle to prevent the speakers from coming loose and presenting a safety hazard.

SUMMARY OF THE INVENTION

The speaker system of the present invention cannot obscure the listener's vision because it is normally mounted behind the listener at a point below the listener's eye level. It presents no physical constraints on the listener's ability to shift his position or otherwise move about. When used in a vehicle, the speaker system of the present invention does not shut out outside sounds, and, because of the way it is mounted—at the seat back—it presents no impact hazard to the listener. The system is removably attachable to the listener's seat in one embodiment, and can be removed from the seat and taken outside the vehicle for entertainment. Alternatively, the system can be unplugged from the vehicle for use elsewhere with another stereo or monaural system. The system generates a unique quality of sound which can be felt as well as heard.

The speaker system of the present invention is intended for operation with two-channel or four-channel stereo systems with or without the use of additional speakers. When used without additional speakers, it provides the effect of stereo headphones without the disadvantages thereof. When used with additional conventional stereo speakers, it provides remarkable stereo enhancement and clarity enhancement of the sound emanating from the conventional stereo speakers. The system may, of course, be operated monaurally be feeding identical signals to both speakers.

The system comprises at least two loud speakers, one for the left channel and one for the right channel. These speakers are mounted in unique enclosures (housings).

The enclosures are of a relatively rigid material such as plastic and are only slightly larger than the speaker, so that each speaker occupies an appreciable fraction of the volume within its enclosure. The walls of the enclosures reverberate from the sound produced and this reverberation can be felt by the listener on his back and in his chest cavity. The dimensions of the enclosures are smaller than the wavelength of all but the higher pitched sounds and as a result, little interference takes place, although there is a general enhancement of the bass frequencies. Each enclosure narrows to form a duct through which the sound is channelled and from which the sound is transmitted. The duct produces a trumpet effect which tends to direct the sound from the left speaker toward the listener's left ear and to direct the sound from the right speaker to the listener's right ear.

In general, the speakers are located behind the listener and at shoulder level approximately. The ducts normally direct the sound in a forward and upward direction toward the listener's ears. The theory of the speaker system is based on the realization that the stereo effect is based upon the phase differences between the channels during reproduction, rather than on the direction from which the sound waves actually originate as in "live listening".

The speaker system produces a unique quality of stereo sound, described as clear and brilliant but with a firmer and louder bass compared to conventional systems. When used in addition to a conventional stereo system, the speaker system of the invention provides a truly remarkable enhancement of stereo separation and of clarity and distinctness of the overall sound heard.

In one embodiment, portions of the exterior of the enclosure are provided with a layer of foamed plastic both to protect the enclosure and, if the system is used in a vehicle, to prevent passengers of the vehicle from being injured by the enclosure in the event of a crash.

With the system of the present invention, outside sounds are not shut out. The listener can hear the outside sounds, particularly if he chooses to concentrate on them. When the system is used in addition to conventional stereo speakers with suitable volume adjustments the listener can experience a blend of the sound from both sets of sound sources, with the system of the invention contributing remarkable enhancement of stereo separation, clarity and distinctness to the overall blend. This is in contrast to the situation with head phones, where the outside sounds are never available to the listener's ears. Thus, if mounted in an automobile, the present invention would not prevent the listener from hearing the sounds produced by emergency vehicles and other traffic sounds, as would head phones. Because the speaker system of the present invention is not worn on the listener's head, it cannot spoil the listener's coiffure.

In a preferred embodiment of the present invention, each of the two speakers has its own enclosure. The enclosures, in turn, are pivotally attached to a spacer bar near its ends. In a preferred embodiment, the length of the spacer bar, which determines the separation between the speakers is adjustable to facilitate mounting the speaker system on the backs of seats of various types.

In an alternative embodiment, two spacer bars connect the speaker enclosures, which are not pivotally mounted. This alternative configuration is particularly useful where the duct portions of the enclosure are positioned in a forward direction and extending forward over the horizontal top surface of the back of a seat.

In other alternative embodiments the speaker enclosures are mounted on a spacer bar which is attached to the riser of an adjustable height stand which can be set immediately behind a chair or couch so as to position the speaker enclosures immediately behind the head of a listener sitting thereon. This type of mounting is especially useful in a home setting and is especially advantageous when the listener is using the speaker system of the invention as an adjunct to a conventional home stereo or quadraphonic system to enhance clarity and stereo separation in the overall sound experience.

In addition, the speaker enclosures of the invention can be readily captured or wedged between a seat back and a room wall, so as to maintain their appropriate desired positions immediately behind the head of a listener occupying the seat, and in such instances, can be used effectively in accordance with the invention without any other mounting means as the main sound system or as an adjunct to a conventional home stereo or quadraphonic system.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 11 is a perspective view of an alternative embodiment of the speaker system in which a special bracket is provided for mounting the system on a particular type of seat back;

FIG. 12 is a side elevation view of the system of FIG. 11 mounted on a seat back;

DESCRIPTION OF THE PREFERRED EMBODIMENT

Figure 1:
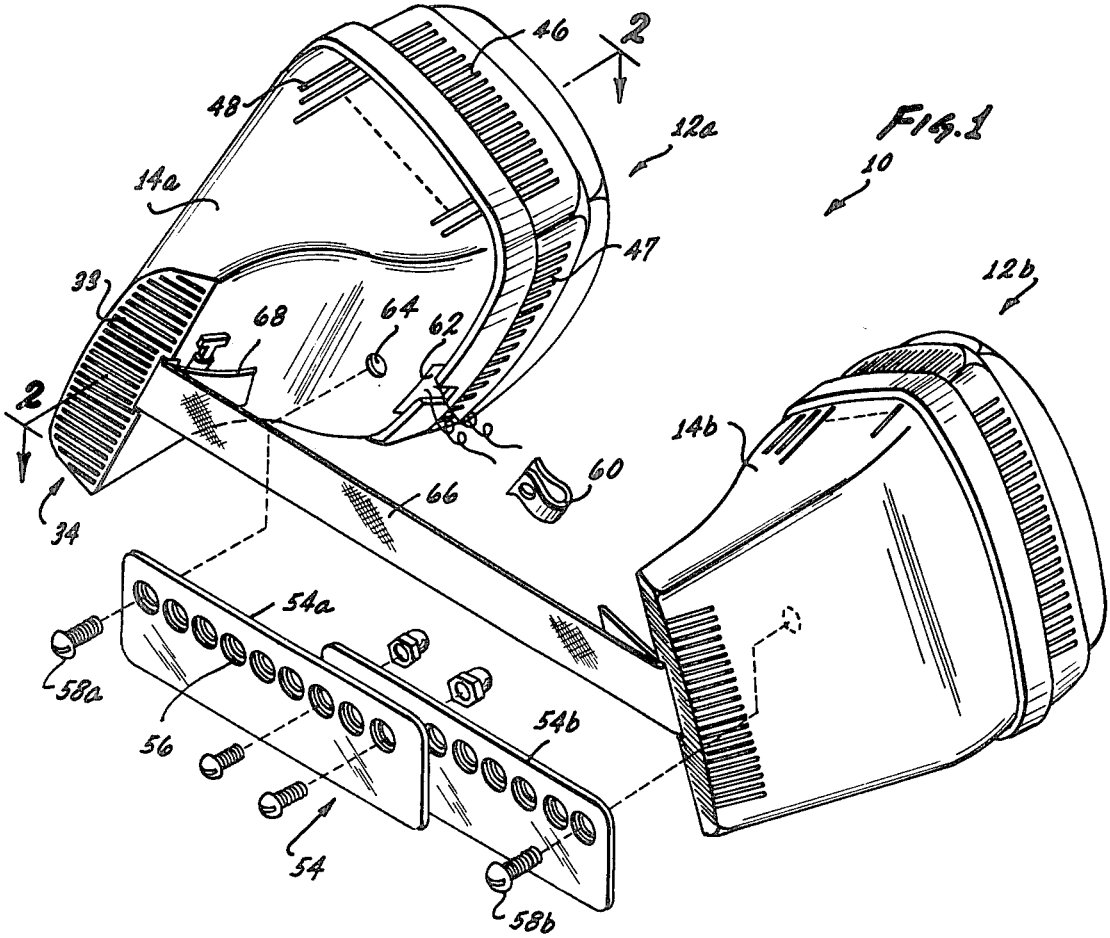
FIG. 1 is a perspective view of a preferred embodiment of the present invention.

Turning now to the drawings, there is shown in FIG. 1 a perspective view of a preferred embodiment of the present invention. The speaker system 10 includes two enclosures **12*a* and 12*b* containing the loud speaker assemblies. The enclosures narrow at one end to form ducts 14*a* and 14*b*** which define passages for directing the sounds produced by the loud speaker assemblies in predetermined directions. The speaker system is normally used with an external stereo signal source, and a cable 22 is used to carry the electrical signals from the remote stereo signal source to the speaker system 10.

A loud speaker assembly, as used in connection with the present invention, may typically include "woofer", "tweeter" and mid-range components to permit each speaker assembly to reproduce with greater fidelity the sounds represented by a single electrical signal. For stereo use, two such speaker assemblies are generally used, deriving their signals from two separate electrical signals: a right signal and a left signal. As used in connection with the present invention, the term "loud speaker assembly" refers to devices intended for normal operation at relatively high input power levels. Thus, the loud speaker assemblies referred to herein do not include headphones and like devices. The enclosure 12*a* of FIG. 1 may be seen in greater detail in FIG. 2. It is identical to the enclosure 12*b* of FIG. 1.

Figure 2:
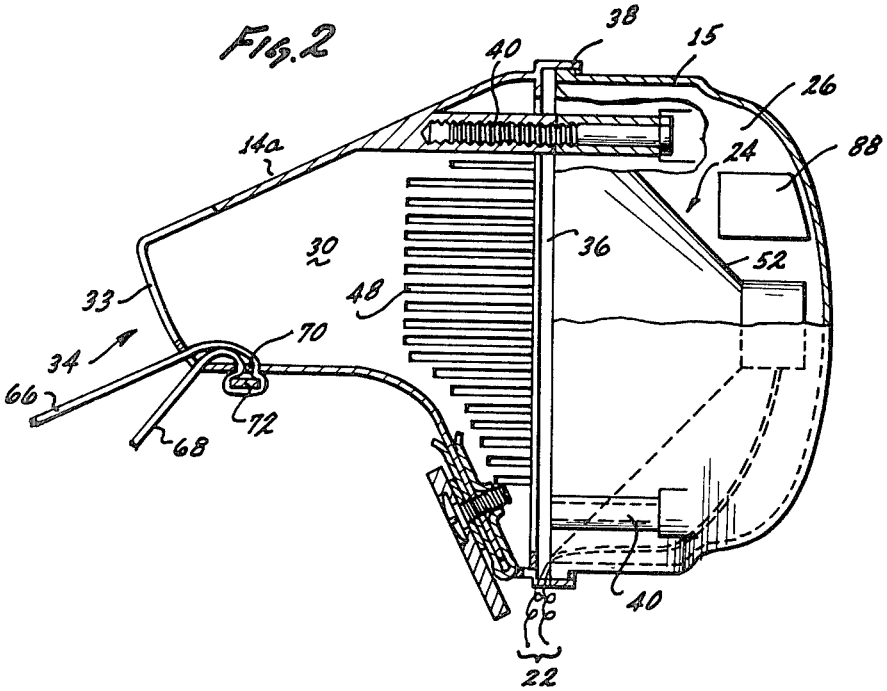
FIG. 2 is a side cross-sectional view of the preferred embodiment taken along the direction indicated by the arrows 2,2 of FIG. 1.

FIG. 2 is a cross-sectional view in a lateral direction shown by the arrows 2—2 of FIG. 1. The enclosure 12*a*, also referred to as a housing, contains a loud speaker assembly 24 of the type described above, and defines a chamber 26 in which the loud speaker assembly is mounted. As shown in FIG. 2, loud speaker assembly 24 occupies a substantial portion of the chamber 26.

Housing 12*a* has a number of holes 46, 47 and 48 on the portion of it adjacent the speaker. These holes provide for a flow of air in and out of chamber 26 as the cone 52 of the loud speaker assembly vibrates.

Housing 12*a* further includes a duct portion 14*a* which defines a passage 30 connecting the chamber 26 with the space outside the housing. In one embodiment, a plurality of slots 33 in the outer end 34 of the duct 14*a* facilitates transmission of the sound from the duct.

In a preferred embodiment shown in FIG. 2, the front end of the speaker cone 52 is connected to a surrounding rim 36. The speaker enclosure 12*a* is assembled by inserting the rim 36 of the speaker assembly into a rim 38 at the rear edge of duct portion 14*a*. Next, the rear portion 15 of the enclosure 12*a* is slipped over the speaker assembly 24 and into the rim 38. The duct portion and the rear portion of the enclosure are next bolted together by the bolts 40.

In a preferred embodiment, the enclosures 12*a*, 12*b* are pivotally attached to a spacer bar 54, which holds the speakers a predetermined distance apart. The pivotal attachment of the enclosures to the spacer bar 54 permits the speakers to be oriented at predetermined angles about the axis of the screws 58*a* and 58*b*. This permits the longer dimension of the outer portion 34 of the duct to be aligned parallel to the sloping sides of a seat, as shown more clearly in FIG. 7.

Although the spacer bar 54 could consist of a single bar with a number of holes 56 spaced along its longer dimension, in the preferred embodiment the spacer bar 54 consists of two similar portions 54*a* and 54*b*. As shown in FIG. 1, these portions can be overlapped by predetermined amounts and then connected together by screws or other fasteners to provide a spacer bar whose length is adjustable in accordance with the width of the seat.

In a preferred embodiment, fastener 60 is slipped through aperture 62 and aligned with a hole 64 in the duct portion 14*a* of the enclosure. The screw 58*a* is then passed through the spacer bar 54 to engage the threads of the fastener, thereby attaching the enclosure 12*a* to the spacer bar 54, as shown in FIG. 2.

Figure 7:
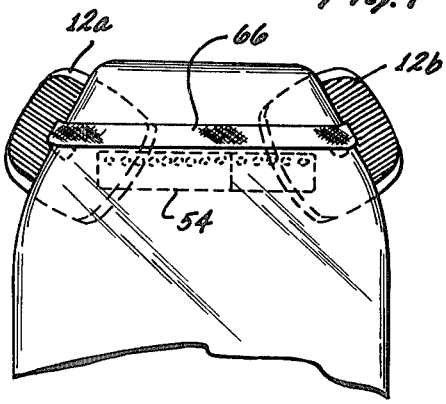
FIG. 7 is a front elevation view of one type of seat back showing a preferred embodiment of the speaker system mounted on it.
Figure 9:
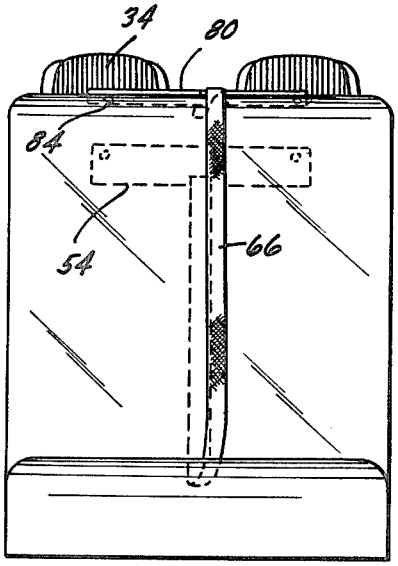
FIG. 9 is a front elevation view of another type of seat back showing an alternative embodiment of the speaker mounted on it.
Figure 10:
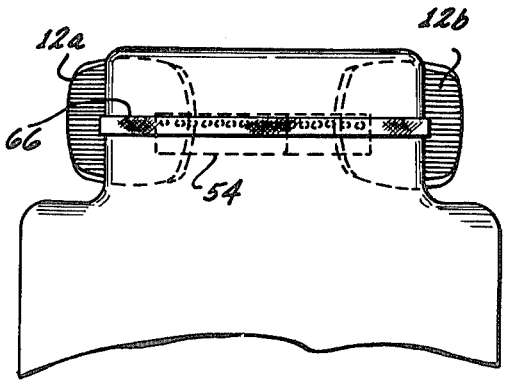
FIG. 10 is a front elevation view of another type of seat back showing a preferred embodiment of the speaker system mounted on it.

The assembly which results when the enclosures 12*a* and 12*b* have been attached to the spacer bar 54 is referred to as the system structure. The stereo speaker system of the present invention further includes a strap for mounting this system structure to the back of a seat. This technique for mounting the stereo speaker system to a seat back is extremely versatile in that it permits reliable mounting to all known types of seat backs, including those which have headrests. FIGS. 7, 9 and 10 illustrate the degree of verstility that can be achieved with this preferred embodiment.

Figure 4:
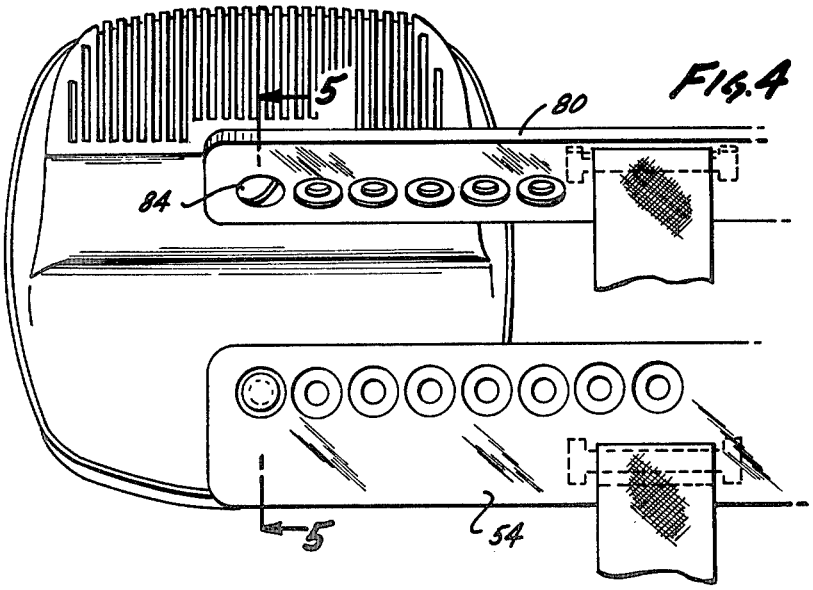
FIG. 4 is a partial front elevation view of an alternative embodiment of the speaker system.
Figure 6:
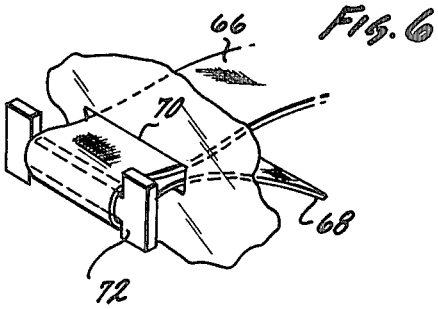
FIG. 6 is a perspective view of the means for attaching a strap to the spacer or to the enclosure of the speaker system in a preferred embodiment.

In the preferred embodiment, a strap 66 may be attached to the system structure at the duct portions of the enclosures or at the spacer bar 54. In a preferred embodiment, the free end 68 of the strap 66 is inserted through a slot 70, passed around an I-shaped part 72 and then passed back through the same slot 70. FIG. 2 shows how the strap is attached to the duct portion 14*a* of the enclosure, and it may also be attached in the same way to the spacer bar through a slot as shown in FIG. 4. The manner in which the strap is attached is shown more clearly in the perspective drawing of FIG. 6.

Figure 3:
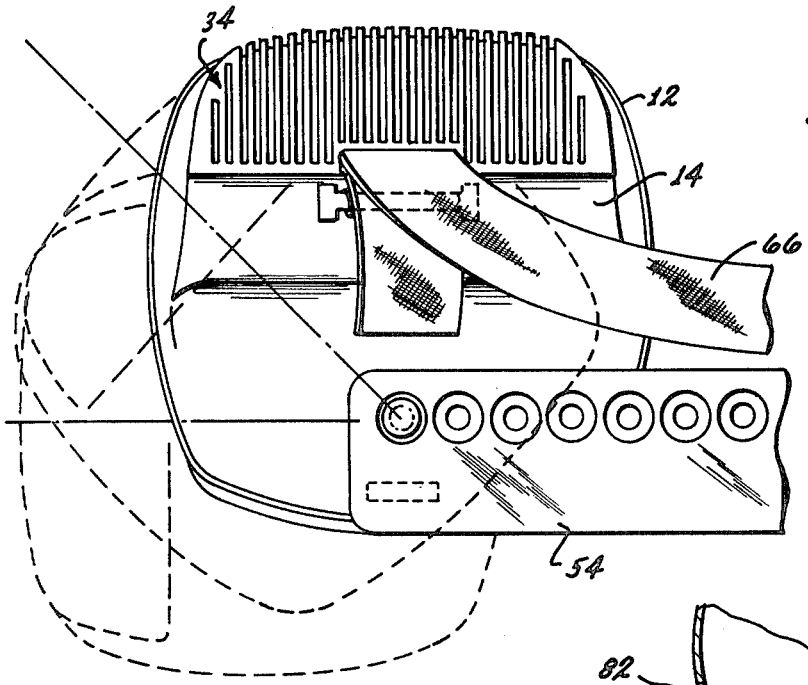
FIG. 3 is a partial front elevation view of a preferred embodiment of the speaker system.
Figure 8:
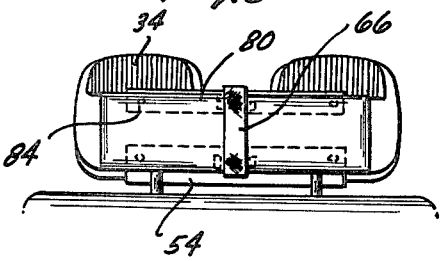
FIG. 8 is a front elevation view of another type of seat back showing an alternative embodiment of the speaker system mounted on it.

As shown in FIG. 3, in a preferred embodiment, each of the enclosures 12 is pivotally attached to the spacer bar 54 to permit the enclosure to be tilted to various orientations as shown by the dashed lines in FIG. 3. In the preferred embodiment shown in FIG. 3, the strap 66 is attached to the outer end 34 of the duct portion 14 of the enclosure. When the strap is attached to the duct portion 14 of the enclosure 12, the system is particularly well adapted for mounting with the longer dimensions of the outer end 34 of the duct in an inclined or vertical orientation as shown in FIGS. 7 and 10 respectively. It is seen that in these applications, it is particularly effective to attach the strap 66 to the duct. A glance at FIGS. 8 and 9 suggests that where the longer dimension of the outer end 34 of the duct portion 14 is more nearly parallel to the spacer bar 54, it is not expedient to attach the strap to the duct portion. The applications shown in FIGS. 8 and 9 are more expeditiously surmounted by attaching the strap to the spacer bar 54.

Figure 5:
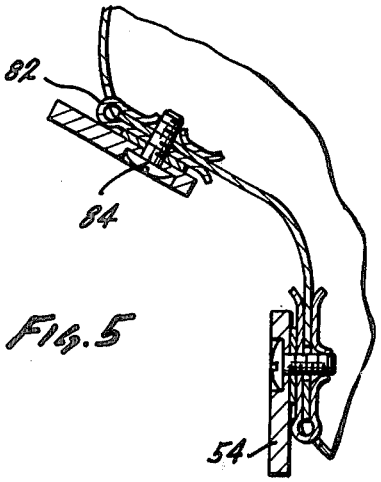
FIG. 5 is a partial cross-sectional side view of the alternative embodiment of FIG. 4.

In applications where it has been determined that the longer dimension of the outer end 34 of the duct is to be oriented parallel to the spacer bar 54, it has been found advantageous to employ an alternative embodiment of the system structure. This alternative embodiment is shown in FIGS. 4, 5, 8 and 9. In that embodiment, a second spacer bar 80 is provided to prevent pivoting of the enclosures. The second spacer bar 80 is, for all practical purposes substantially similar to the spacer bar 54. Like the spacer bar 54, the spacer bar 80 is attached to the duct portion 14 of the enclosure 12 by a fastener 82 and a screw 84. FIGS. 4 and 5 show the manner in which the second spacer bar 80 is attached to the duct portion 14 of the enclosure 12. In the alternative embodiment of FIG. 4, a first end of the strap 66 is attached to the first spacer bar 54, the strap is then passed around a headrest as shown in FIG. 8 or around the entire back of the seat as shown in FIG. 9, and the free end of the strap is then attached to the second spacer bar 80. If the strap is tightened snugly, the system structure will be held securely to the seat back or the headrest.

If the back of the seat has a horizontal top surface which is arched forward at either side, the alternative embodiment of FIG. 4 could be used provided the first spacer bar 54 is omitted and both ends of the strap 66 are secured to the second spacer bar 80. In such an application, the enclosures 12*a* and 12*b* would be "towed-in" somewhat towards the medial plane of the seat.

In other embodiments, the strap 66 is made of an elastic material which is stretched lengthwise around a portion of the back of the seat. Alternatively, an inelastic strap may be provided with an elastic element such as a spring at some point along its length.

The unique mounting system used in the present invention permits rapid mounting of the system structure to virtually any kind of seat back. Conversely, the system structure can be rapidly removed from the seat back and carried to another location or mounted on a different seatback.

In yet an additional embodiment, a radio receiver 88 of FIG. 2 may be included within one or both of the speaker enclosures, thereby eliminating the necessity for a cable such as cable 22 of FIG. 2, connecting the speaker system with a source of electrical signals.

FIGS. 11 and 12 show an alternative apparatus for mounting the system structure to a seat back. In that embodiment, a bracket 90 is attached to the spacer bar 80 to keep the system in place on the seat back.

The bracket 90 is formed by attaching a forwardly-extending bar 92 to the spacer bar 80, and then attaching a downwardly-extending member 94 to the bar 92 to form the bracket.

The embodiment of FIGS. 11 and 12 is particularly intended for mounting the speaker system structure to non-moving seats, such as the easy chairs used in homes, where it is not necessary to secure the system against forces of acceleration such as are encountered in vehicles.

Figure 13:
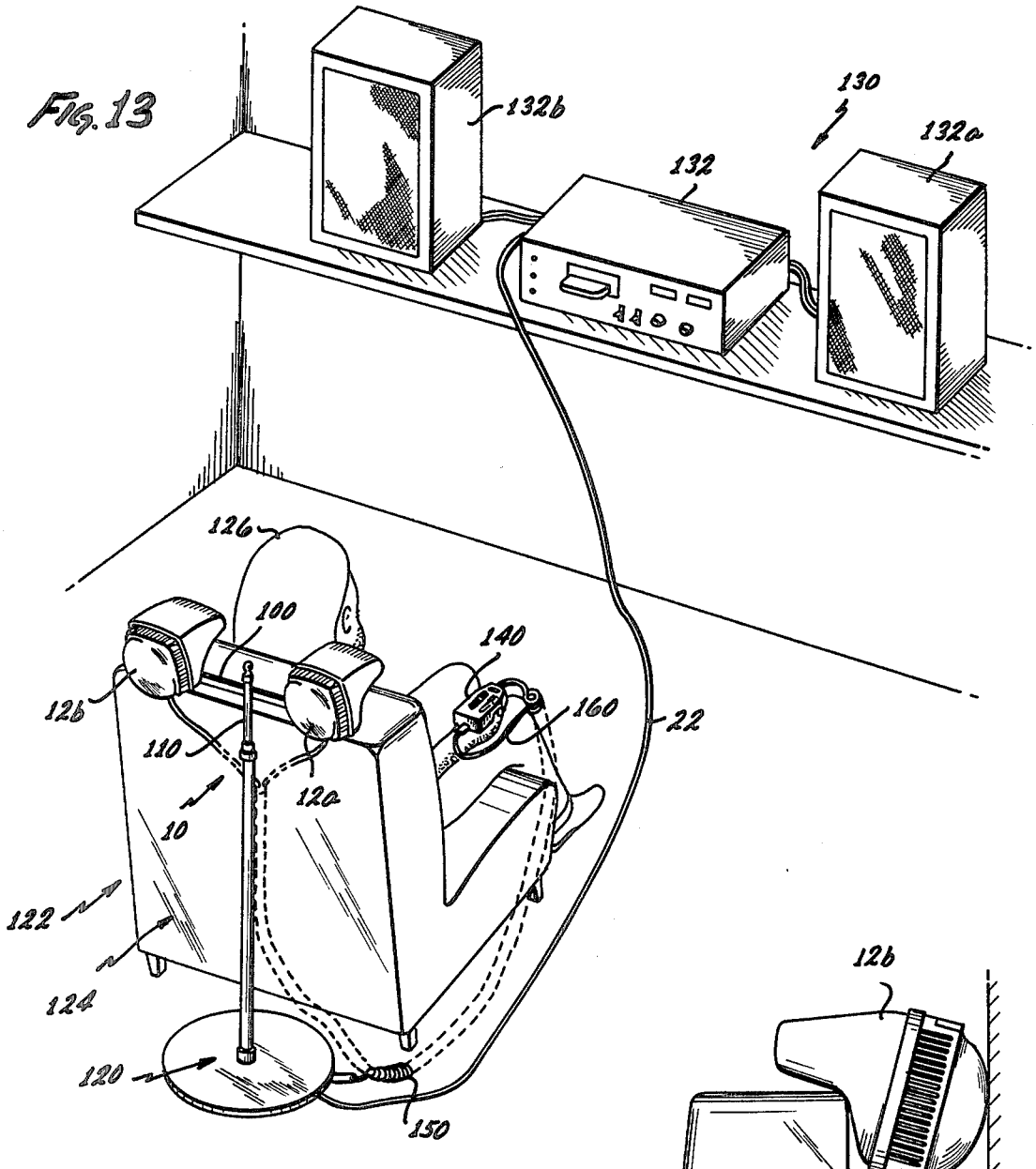
FIG. 13 is a perspective view of a stand mounted speaker system set behind a seat back to enhance the sound of a conventional stereo system.

FIG. 13 shows an alternative apparatus for mounting the speaker system 10 at a seat back, which is again especially advantageous for use with relatively stationary seats such as chairs and couches used in homes. As shown in FIG. 13, the speaker system comprising speaker enclosures 12*a* and 12*b* is mounted on a spacer bar 100 which is in turn mounted to the riser 110 of an adjustable height speaker stand generally designated 120 which is set immediately behind a seat back 124 of a seat generally designated 122, the height and position of the stand 120 being adjusted so as to position the speaker enclosures 12*a* and 12*b* in such manner that preferably their ducts protrude over the top of the seat back 124 and are positioned immediately behind the expected position of the head of a listener 126 who is seated in the seat 122, each speaker enclosure being directed alongside a respective side of the listener's head so that the sound from each speaker enclosure is channeled respectively towards the listener's ears.

As shown in FIG. 13, the speaker system 10 of the invention is being utilized as an adjunct to a conventional stereo speaker system generally designated 130 which as shown in FIG. 13 may consist of a stereo receiver-amplifier 132 having cassette tape playing capability, driving a pair of companion stereo speakers 132*a* and 132*b* which are spaced apart opposite the listener 126 to provide conventional stereo sound to the listener. The receiver-amplifier 132 acts as a stereo signal source and provides stereo electrical signals to speakers 132*a* and 132*b* and also provides such signals through the cable 22 to the stereo speaker system 10 mounted on stand 120.

In the particular embodiment of such an arrangement shown in FIG. 13, the cable 22 does not feed its stereo signals directly to speaker system 10, but instead does so through an intermediate stereo volume control 140 which can be retained and held and controlled by the listener 126 so as to permit convenient blending of the sounds on the stereo speaker system 10 with the overall sounds emanating from the stereo speakers 132*a* and 132*b* of conventional stereo system 130. As a matter of convenience of electrical connection, the cable 22 is connected within the hollow base of speaker stand 120 to an intermediate cable 150 through which the stereo signals are conducted to the volume control 140, the output leads 160 from the volume control 140 looping back to be enclosed within cable 150 and branching off at the base of intermediate cable 150 near the base of the speaker stand to traverse up the speaker stand and make connection to the individual stereo speaker enclosures 12*a* and 12*b* respectively of the stereo speaker system 10 of the present invention.

When the stereo speaker system 10 of the invention is used as shown in FIG. 13 as an adjunct or addition to a conventional stereo system, a remarkable enhancement of the overall sound is experienced. Unlike head phones, the speaker system of the invention does not attach to the listener's head and does not block the sounds of the conventional stereo system from the listener's ears. At the same time the speaker system of the invention is so close to the listener's ears that it is operated at a relatively low volume level so that the operation of the speaker system of the invention does not disturb other listeners in the room. Moreover, the stereo speaker system of the invention provides completely remarkable and unexpected enhancement of the stereo separation of the overall sound and of the clarity of the overall sound, together with complete preservation of the experience of hearing very high fidelity sound. Thus, even though the stereo speakers of the invention may be of medium or medium-low fidelity in an absolute sense, when used in combination in the manner shown with a conventional stereo or quadraphonic high fidelity system, the overall experience is one of hearing completely high fidelity sound, with a remarkable enhancement of stereo separation and a remarkable enhancement of clarity and distinctness of sound, as for example in clarity of intricate vocal or instrumental passages and distinctness of spoken or sung words.

It is believed that one reason for the maintenance of a totally high fidelity experience, even with a speaker system employing medium fidelity or medium-low fidelity speakers, is that the speakers, because of their close proximity to the listener's ears, will be operated at a relatively low volume level which maximizes the effective fidelity of the speaker. However, it is believed that this effect is only one component that contributes to the maintenance of a totally high fidelity effect and that other primarily psychological mechanisms are involved which are not yet understood, but which contribute to this unexpected effect of retention of a totally high fidelity experience.

When the stereo speaker system of the invention is used with a conventional stereo with no quadraphonic capability, listeners attest that the experience is nevertheless similar to that of a superlatively fine quadraphonic system, creating the experience of sound being directed at the listener from every direction in the room The sound experience is so entirely different and remarkable that it has been given the special designation of "omniphonic" sound. Even when used with a receiver having quadraphonic output capability, the speaker system of the present invention provides a stereo enhancement and clarity enhancement and enhancement of brightness and brilliance of tone which far surpasses that available in conventional quadraphonic systems. It will be noted that in a conventional quadraphonic system a second set of speakers are positioned in the room to the rear of the listener but at a considerable distance therefrom, rather than immediately behind the listener's ears.

Figure 14:
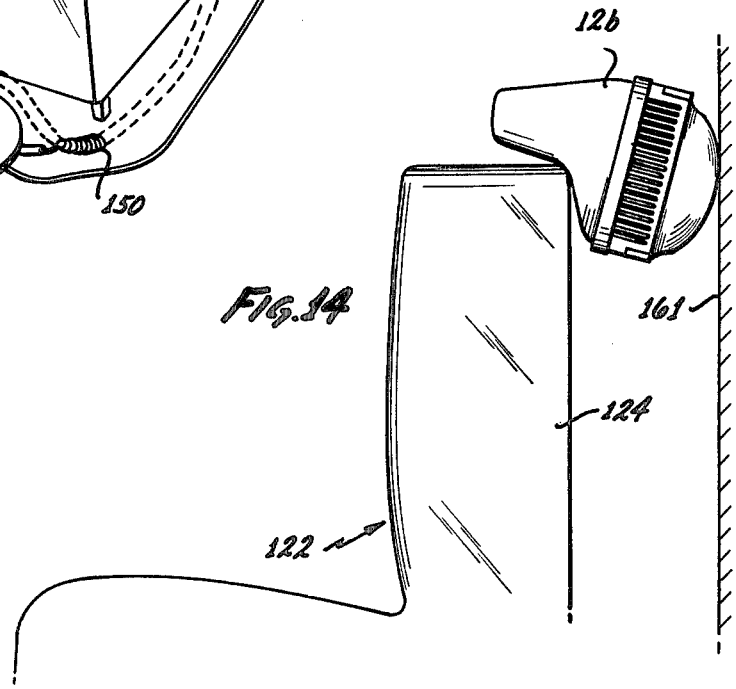
FIG. 14 is a profile view of the speaker enclosures captured between a seat back and a room wall.

As indicated in FIG. 14, if the seat 122, which may be a chair or a couch or other type of seating furniture, is relatively immobile and is positionable in proximity to a room wall 161, then the speakers 12*a* (not visible in the profile view of FIG. 14) and 12*b* can be mounted in the correct position at the seat back by simply capturing them between the seat back 124 and the wall 161 as shown in FIG. 14, and in such event the use of a mounting stand 120 can be dispensed with.

The protruding duct of the speaker enclosures 12*a* or 12*b* lends itself in such usage to resting upon the corner of the seat top and the seat back and the rounded bulbous back of the speaker enclosure lends itself to resting against the wall so that the speaker enclosure may be readily captured between the seat back and the wall.

In the arrangement shown in FIG. 13, the use of a volume control 140 under the immediate control of the listener 126 is preferred, but it will be recognized that the use of such a volume control can be dispensed with by suitable manipulation of the volume controls available in the receiver-amplifier 132. This is especially true if the receiver-amplifier 132 has auxiliary (aux) outputs for two additional speakers with separate volume controls for these additional speakers, for in such event the aux outputs can be utilized by the speaker system of the invention and blending accomplished by adjustment of the corresponding auxiliary volume controls on the receiver-amplifier 132.

Figure 16:
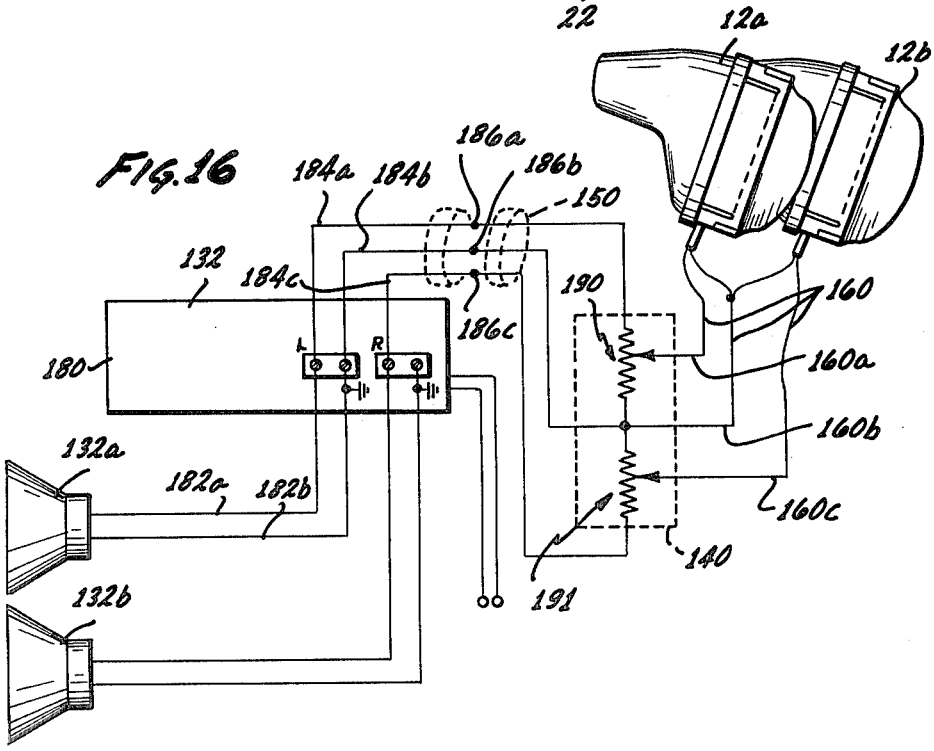
FIG. 16 is a schematic electrical diagram showing electrical interconnections between the speaker system and other components.

In FIG. 16 a schematic wiring diagram is shown of one suitable interconnection of the components shown in FIG. 13. As shown in FIG. 16, the receiver-amplifier 132 has a rear panel 180 which has two contact pairs labeled L and R for providing left and right stereo signals to external speakers. As shown in FIG. 16, each of the L and R contact pairs includes a grounded contact. Although the receiver-amplifier 132 may also have auxiliary (aux) output contacts for driving additional external speakers, in the particular circuit arrangement shown in FIG. 16, such aux output contacts are not utilized and the speaker enclosures 12*a* and 12*b* of the invention are essentially operated in parallel respectively with the conventional stereo speakers 132*a* and 132*b*. Thus the L output contacts are connected by conductive leads 182*a* and 182*b* to speaker 132*a* and are also connected by conductive leads 184*a* and 184*b* to stereo volume control 140 which issues corresponding output leads 160*a* and 160*b* which are connected to stereo speaker assembly 12*a*. Similarly the R output contacts of receiver-amplifier 132 are connected to speaker 132*b* and are also connected by conductive lead 184*c* to a third input of stereo volume control 140 which provides leads 160*c* and 160*b* as its corresponding output leads to furnish volume-adjusted stereo signals to stereo speaker assembly 12*b*. In the particular arrangement shown in FIG. 16, conductive leads 184*b* and 160*b* serve as common ground leads which are connected to the common ground of receiver-amplifier 132, and lead 160*b* is branched to supply corresponding ground leads to each of the speakers 12*a* and 12*b*.

Leads 184*a*, 184*b* and 184*c* are bundled together to make the common cable 22 leading to a group of contact terminals 186*a*, 186*b* and 186*c* which are established either directly or as part of a plug and jack arrangement at the hollow base of stand 120. The continuing leads emanating from each of these contact terminals are bundled together in common cable 150 to make connection to volume control 140.

As shown in FIG. 16, volume control 140 comprises two resistive potentiometers 190 and 191 respectively. Potentiometers 190 is connected in shunt across the L contacts and potentiometer 191 is connected in shunt across the R contacts. Each potentiometer is tapped at a volume level for proper blending, determined by the listener's manual adjustment, to supply volume adjusted stereo signals which are supplied via leads 160*a* and 160*b* to speaker enclosure 12*a* and via leads 160*c* and 160*b* to speaker enclosure 12*b*. It should be recognized, of course, that in an alternative embodiment of volume control 140, rather than providing volume control by interposing tapped shunt resistors, volume control could also be accomplished through use of tapped series resistors. In such an embodiment of volume control 140, the potentiometers 190 and 191 would simply be disconnected from the common ground lead so that they present series resistence in leads 160*a* and 160*c* to the passage of stereo signals. It should also be recognized that use of a local variable volume control is not essential, since in many instances suitable volumes attenuation can be obtained through use of volume controls at the receiver-amplifier and/or use of suitable fixed attenuating resistors placed in the circuit.

Figure 15:
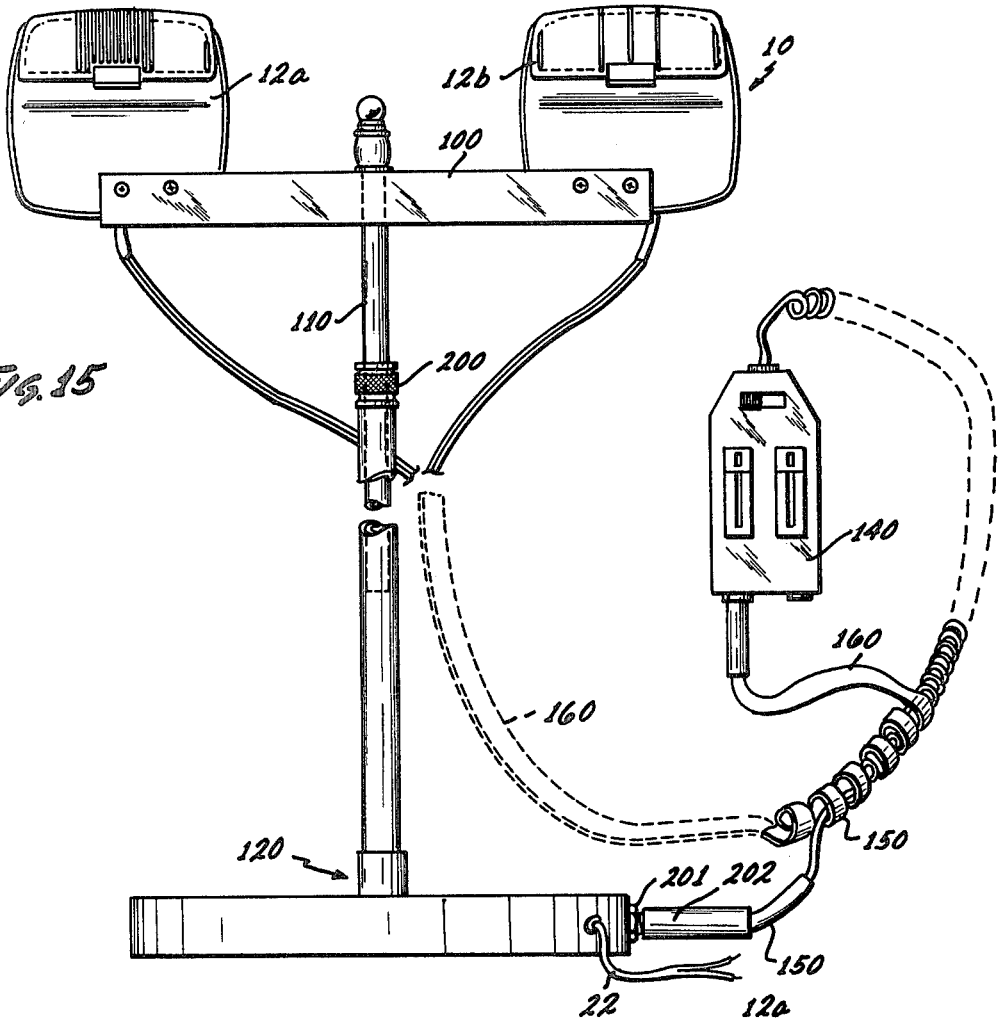
FIG. 15 is a front elevation view of the stand mounted speaker system of FIG. 13.

Referring now to FIG. 15, for purposes of full and convenient understanding, the stand mounted speaker system 10 of FIG. 13 is shown in direct frontal view, and it is seen that in the preferred embodiment speakers 12*a* and 12*b* are each mounted to spacer bar 100 with two spaced screws extending through the spacer bar 100 and into the face of the speaker enclosures so as to non-rotatably position the speaker enclosures at the appropriate spacing, the free spacing between the sides of the speakers being approximately equal to the width of a human's head or approximately inches. As previously indicated, the spacer bar 100 is mounted by welding or otherwise to the riser 110 of the stand 120. The riser 110 can be raised or lowered telescopically with respect to the base member as desired, by loosening the clamping ring 200, adjusting the height of the riser as desired, and re-tightening the clamping ring. As shown in FIG. 15, the cable 22 from the stereo source enters into the hollow base of the speaker stand 120 and is connected to a receptacle 201 so as to make contact with the contacts of a jack 202 which terminates the leads of cable 150. Cable 150 as shown continues on to supply the conductive leads to volume control 140 whose output leads 160 are looped back into cable 150 and descend down the cable to a point close to the base of stand 120 at which point they branch out of the cable and upwards along the vertical elements of the speaker stand to supply individual pairs of leads to speaker enclosures 12*a* and 12*b* respectively.

Although as shown in FIG. 15 the speaker enclosures 12*a* and 12*b* have a smooth surface in the area in which they are attached by screws to spacer bar 100, it will be recognized that speaker enclosures 12*a* and 12*b* may also be provided with protruding abutments in these faces aligned with one edge of the spacer bar so as to block rotation of the speaker enclosure relative to the spacer bar and in such event connection between the spacer bar and each speaker enclosure may be made with only a single screw connection for each speaker.

It is further recognized that for some applications, as for example use with high and/or rounded seat backs, it is desirable that the speaker assemblies be rotatable with respect to the spacer bar to allow adjustment to fit seat back contour, and in such event a single screw connection without any abutment may be utilized.

Thus, there has been described a speaker system having a unique housing, including a duct portion for channeling the sound generated toward the listener's ears.

Unlike headphones, the speaker system does not attach to the listener's head and does not block out external sounds from the listener's ears. This in turn permits a listener to use the speaker system as an enhancing addition to a conventional stereo or quadraphonic system to blend with the overall sound in such manner as to markedly enhance stereo separation and clarity.

The speaker system of the present invention does not restrict the listener's ability to move about, nor does it obscure his vision.

The speaker system disclosed above includes novel means for mounting the speaker system immediately behind a wide variety of seat backs.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. A stereo speaker system structure for mounting at the back of a seat, adapted for use as a sound enhancing adjunct to a conventional stereo system including a source of stereo electrical signals to enhance stereo separation and clarity of the overall sound, said stereo speaker system comprising:

first and second loud speaker assemblies, each including at least one loud speaker;

an enclosure means for enclosing each of said loud speaker assemblies, comprising a shell of rigid material substantially surrounding said loud speaker assembly on all sides to form a chamber substantially occupied by said loud speaker assembly and having an opening on one side thereof for emitting sound produced by its respective loud speaker;

at least one elongated spacer comprising an elongated member having means for positioning each enclosure at a preselected location along its length to form a system structure comprising two of said enclosures held at a predetermined spacing from each other by said at least one elongated spacer;

means operable for positioning said first and second speaker assemblies at the back of a seat respectively adjacent and rearward of the expected position, respectively of the left and right ears of the head of a seat occupant to emit sound at the occupant's ears; and means operable for electrically coupling the speakers to the source of stereo electrical signals.

2. The stereo speaker system structure of claim 1, wherein each enclosure includes an upper portion having a sound emitting opening and further includes a lower portion having a downwardly extending section which is adapted to be captured between the seak back and an adjacent room wall.

3. The stereo speaker system structure of claim 1, wherein said means for electrically coupling the stereo speakers to the source of stereo electrical signals includes a manually adjustable stereo volume control unit electrically interconnected between the stereo speakers and the source of stereo electrical signals, and freely positionable in the immediate proximity of the speaker assemblies to permit manual adjustment thereof by a human occupant of the seat when the speaker assemblies are positioned immediately behind the seat.

4. The stereo speaker system structure of claim 3, wherein said means operable for positioning the stereo speaker assemblies comprises a vertically height adjustable stand having the speaker assemblies attached thereto and having a base member having an electrical interconnection unit attached thereto, said interconnection unit electrically interconnecting said source of stereo electrical signals and said stereo volume control unit.

5. A stereo speaker system structure for mounting at the back of a seat, adapted for use as a sound enhancing adjunct to a conventional stereo system including a source of stereo electrical signals to enhance stereo separation and clarity of the overall sound, said stereo speaker system comprising:

two loud speaker assemblies, each including at least one loud speaker;

an enclosure for each of said loud speaker assemblies, comprising a shell of rigid material substantially surrounding said loud speaker assembly on all sides to form a chamber substantially occupied by said loud speaker assembly;

at least one elongated spacer comprising an elongated member having means for positioning each enclosure at a preselected location along its length to form a system structure comprising two of said enclosures held at a predetermined spacing from each other by said at least one elongated spacer;

means operable for positioning the speaker assemblies at the back of a seat immediately behind the expected position of the head of a seat occupant to channel sound at the occupant's ears, said means including a stand having a vertically height adjustable riser to which the elongated spacer is connected, said stand being settable immediately behind a seat back; and means operable for electrically coupling the speakers to the source of stereo electrical signals.

6. A speaker system structure for mounting at the back of a seat, adapted for use as a sound enhancing adjunct to a conventional stereo system including a source of stereo electrical signals to enhance stereo separation and clarity of the overall sound, said stereo speaker system comprising:

two loud speaker assemblies, each including at least one loud speaker;

an enclosure for each of said loud speaker assemblies, comprising a shell of rigid material substantially surrounding said loud speaker assembly on all sides to form a chamber substantially occupied by said loud speaker assembly and narrowing on one side to form a duct for directing sound produced by said loud speaker assembly;

at least one elongated spacer comprising an elongated member having means for positioning each enclosure at a preselected location along its length to form a system structure comprising two of said enclosures held at a predetermined spacing from each other by said at least one enlongated spacer;

means operable for positioning the speaker assemblies at the back of a seat immediately behind the expected position of the head of a seat occupant with the ducts protruding above the top portion of the seat back to channel sound at the occupant's ears; and means operable for electrically coupling the speakers to the source of stereo electrical signals.

7. The stereo speaker system structure of claim 6, wherein said means for electrically coupling the stereo speakers to the source of stereo electrical signals includes a manually adjustable stereo volume control unit electrically interconnected between the speakers and the source of stereo electrical signals, and freely positionable in the immediate proximity of the speaker assemblies to permit manual adjustment thereof by a human occupant of the seat when the speaker assemblies are positioned immediately behind the seat.

8. The stereo speaker system structure of claim 7, wherein said means operable for positioning the stereo speaker assemblies comprises a vertically height adjustable stand having the speaker assemblies attached thereto and having a base member having an electrical interconnection unit attached thereto, said interconnection unit electrically interconnecting said source of stereo electrical signals and said stereo volume control unit.

* * * * *